United States Patent [19]

Shaw

[11] 4,301,617

[45] Nov. 24, 1981

[54] MODEL STEAM LOCOMOTIVES

[76] Inventor: Christopher W. Shaw, Starfitts House, Kirkbymoorside, York, N. Yorkshire, England

[21] Appl. No.: 69,837

[22] Filed: Aug. 27, 1979

[30] Foreign Application Priority Data

Aug. 30, 1978 [GB] United Kingdom ..... 34919/78

[51] Int. Cl.[3] ..... A63H 19/10

[52] U.S. Cl. ..... 46/257

[58] Field of Search ..... 46/231, 257, 260, 217; 105/49, 37, 48, 108, 117

[56] References Cited

U.S. PATENT DOCUMENTS 2,030,201 2/1936 Gilbert ..... 105/37

2,595,936 5/1952 Goode ..... 46/217 X 2,814,257 11/1957 Joyce ..... 105/49

*Primary Examiner*—F. Barry Shay

*Attorney, Agent, or Firm*—Brisebois & Kruger

[57] ABSTRACT

In a model of a steam locomotive which is driven by an electric motor and includes a model reproduction of the valve gear regulating the steam control valves of the steam cylinders, the electric motor is coupled to the axle of a set of driving wheels of the model via a drive shaft, which is permitted a limited amount of axial float and is coupled to the axle by a gearbox. Axial movement of the drive shaft is produced by interaction between the gears of the gearbox and is controlled by coil springs disposed on the shaft at opposite ends of the gearbox. These axial movements result from changes in the amount and direction of the torque applied to the gearbox by the electric motor and are transmitted to the model valve gear by an axially movable rod. Hence the configuration of the model valve gear is continuously changeable in accordance with the required pulling power and direction of movement of the model locomotive so that the position of the model valve gear substantially corresponds to that of the real locomotive when operating under similar conditions, thereby providing for more realistic operation of the model.

6 Claims, 1 Drawing Figure

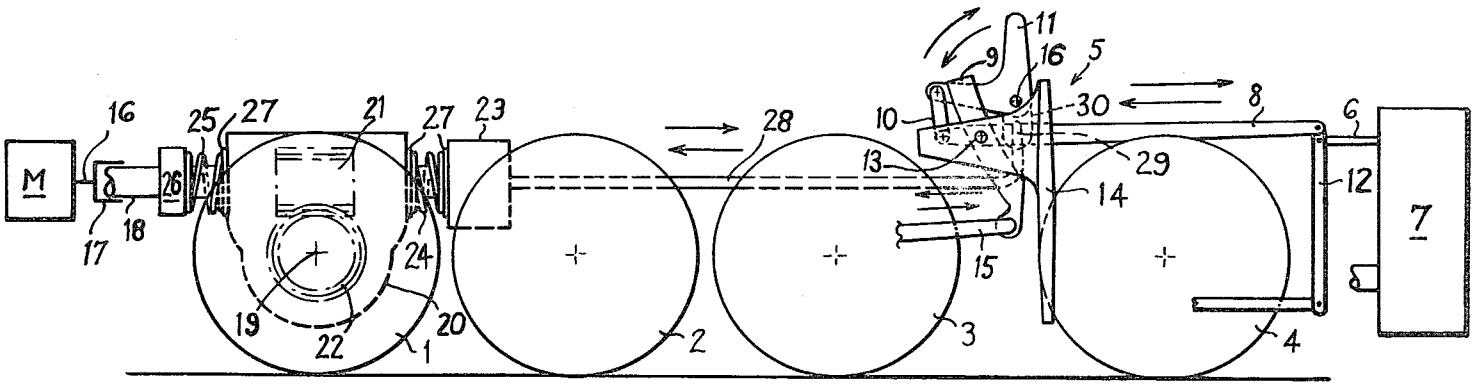
7
6
12
8
4
29
14
5
30
11
16
9
15
3
10
13
28
2
23
27
20
24
1
21
22
19
27
25
26
18
16
17
M

MODEL STEAM LOCOMOTIVES

BACKGROUND OF THE INVENTION

The present invention relates to model steam locomotives or railway engines and, more particularly, to valve gear reproduced in such models.

An essential element of a real steam locomotive is the valve gear, which is a gear designed to control the admission and discharge of steam to and from the cylinders of the locomotive. One of the preferred types of valve gear is known as the Walscheart's valve gear.

On a real steam locomotive, the valve gear is arranged to be under the control of the driver who, by altering its configuration, adjusts the pulling power of the locomotive to the load. For completeness, it should be added that there are other factors involved which also enable the power of a locomotive to be adjusted in accordance with the load that it has to pull, among which are the boiler pressure and the regulator opening.

In models of locomotives fitted with valve gear, a considerable increase in realism is obtained by modelling this valve gear. In the case of a model, there being no driver, generally no attempt has been made to construct the valve gear so that it alters its configuration in a realistic manner according to the load being pulled by the locomotive, although some attempt has been made in the case of model locomotives actually driven by steam. This invention, however, relates to model locomotives driven, in a manner which is now commonplace, by electric motors connected either to the driving wheels of the model locomotive or other subsidiary wheels. In this case, as there is no functional need to alter the configuration of the valve gear and the scale of the locomotive is usually such that small mechanisms are difficult to alter, it is customary to model the valve gear in a single, set configuration.

The specific alteration of the configuration in a steam locomotive fitted, for example, with Walscheart's valve gear, which was visible to a bystander, was the alteration of the radius rod with respect to the expansion link. The radius rod was provided with a degree of radial travel such that the ability of the locomotive to do work could be smoothly altered from a position which produced maximum effort in a forward direction to a position which produced maximum effort in a reverse direction. Most intermediate positions were also available including a mid-position which prevented the locomotive from exerting any effort in either direction. In modelling Walscheart's valve gear in locomotives available on the market, the radius rod is almost invariably positioned in the mid-position such that the locomotive is apparently configured for producing no effort in either direction.

It has hitherto been known to construct scale model steam locomotives powered by electric motors with valve gear which can be configured from a certain forward motion position to another certain backwards motion position by means of a device known as a slip eccentric mounted on a convenient axle. By means of this device, the valve gear is configured from one of the two available positions to the other each time the locomotive changes its direction of travel. It is recognised that this gives an increased degree of realism over a locomotive fitted with valve gear fixed in the mid-gear-position, but it is still not a true reproduction of the full scale gear.

SUMMARY OF THE INVENTION

It is a primary object of the present invention to provide an electrically driven model of a steam locomotive in which the valve gear is reproduced in the model and the configuration of the model valve gear is continuously changeable in accordance with the required pulling power and direction of movement of the model locomotive so that the position of the model valve gear substantially corresponds to that in the real locomotive when operating under similar conditions, thereby providing for more realistic operation of the model.

The present invention consists in a model steam locomotive driven by an electric motor, including a model reproduction of the valve gear regulating the steam control valve of each cylinder, a torque responsive device arranged to respond to the torque produced by the electric drive motor, and means linking the torque responsive device to the model valve gear so as to alter the configuration of the valve gear in response to the amount and direction of the torque applied by the drive motor.

Conveniently, the torque responsive device is arranged to produce a linear output movement in response to the applied torque of the electric motor and in opposite directions depending on the direction of the torque. For example, the drive motor may be coupled to the axle of a drive wheel or set of drive wheels of the model via a drive shaft which is permitted a limited amount of axial float and which is axially movable, in response to the applied torque, against the action of spring means. The axial movements of the drive shaft resulting from changes in the applied torque and the direction of rotation of the drive shaft are transmitted to the valve gear by suitable linking means. In a preferred embodiment, the drive shaft is connected to the axle of the drive wheels by a gearbox which includes a worm gear or crossed helical gear fastened to the shaft and meshing with a worm wheel or crossed helical gear fastened to the axle. When torque is applied to the drive shaft, there is a reaction between the gears of the gearbox which produces a force along the axis of the drive shaft which causes this to move in one or other axial direction, depending on the direction of the applied torque, against the action of the spring means. The latter controls movement of the drive shaft and returns it to a mid or rest position with respect to the gearbox when no torque is being applied by the electric motor and, hence, the locomotive is exerting no pulling power. Means is provided for accommodating the axial motion of the drive shaft without disturbing other elements of the drive train. For example, an appropriate sliding coupling may be provided for this purpose. Alternatively, the drive shaft may be driven through the spring means which connects the drive shaft to an input shaft and is capable of allowing axial movement of the drive shaft relative to the input shaft. Such a device is marketed by STURM DRIVES LTD under the trade name HELI-CAL.

In another embodiment the torque responsive device may comprise a threaded shaft having a nut running thereon which permits the nut to be movable in one direction or another against the action of springs according to the torque being applied. In a further embodiment, the torque responsive device may be similar to a spring clutch which permits a variation in the position of one clutch member relative to another, by means of springs, according to the applied torque.

BRIEF DESCRIPTION OF THE DRAWING

In order that the present invention may be more readily understood, reference will now be made to the accompanying drawing which is a fragmentary view diagrammatically illustrating the driving wheels and pertinent parts of a model steam locomotive embodying the invention and fitted with a model reproduction of a Walscheart's valve gear.

DESCRIPTION OF PREFERRED EMBODIMENT

Referring to the drawing, the model steam locomotive includes four sets of driving wheels 1-4, which are coupled together by coupling rods (not shown) in any appropriate manner, and a set of Walscheart's valve gear which, in the real locomotive, regulates the slide, piston or other type of valve controlling admission of steam to the cylinder. Only part of one set 5 of the valve gear is shown in the drawing and it will be appreciated that this is duplicated elsewhere on the locomotive. The significant part of the valve gear 5 comprises a valve rod 6 for controlling the slide, piston or other type of valve housed in the cylinder 7, a radius rod 8, a curved expansion link 9, a hanging link 10 and a bell crank 11. The radius rod 8 is pivoted at one end to the combination lever 12 connecting it inter alia to the valve rod 6 and at its opposite end it is free to slide up and down the expansion link 9. It is slidably connected to the expansion link by means of an intermediate component known as a die block (not shown).

The expansion link 9 is pivoted, at 13, to a fixed part 14 of the locomotive frame and is rocked by means of an eccentric rod 15 pivoted to its lower end. The position of the radius rod 8 with respect to the expansion link 9 is controlled by the bell crank 11 which is pivoted at 16 to the locomotive frame and is connected to the adjacent end of the radius rod by the hanging link 10. The radius rod is raised and lowered relative to the expansion link in response to rocking of the bell crank, which in the real locomotive is controlled by the driver. Other convenient mechanisms for raising and lowering the radius rod 8 have been used from time to time on real locomotives and may, consequently, be used in models, but it is believed to be sufficient for the purposes of explaining this invention solely to describe the bell crank control mechanism.

The model locomotive is driven by an electric motor M installed in the cab and boiler of the model (not shown) and, in accordance with common practice, is arranged with its output shaft 16 in a fore and aft direction. The output shaft of the motor is directly or indirectly connected, via a suitable sliding coupling, schematically indicated at 17, to a drive shaft 18 which transmits the drive to the axle 19 of the rear set of driving wheels 1. The drive shaft 18 is coupled to the axle 9 by a gearbox 20 comprising a worm gear or a crossed helical gear 21 fasten to the drive shaft and meshing with a worm wheel or crossed helical gear 22 fasten to the axle 19. The helical gears, if used, may be of the same or different diameters. In this embodiment of the invention it is important that the final drive to the driven axle is either by means of a worm and worm wheel or by an arrangement of crossed helical gears. The reason for this is that when torque is applied to the drive shaft 18, there is an interaction between the meshing pairs of gears 21,22 which produces a force along the axis of the drive shaft, this force being proportional to the torque exerted on the driven axle.

The drive shaft 18 is mounted in the gearbox 20 in such a manner that it can float to a predetermined limited extent in an axial direction, the extent to which it is permitted to float depending on the scale of the model. Typically the permitted range of float will be from 0.050 inches to 0.2 inches when the invention is applied to scale model locomotives of approximately one-eight-yseventh full size. The available float may be different in models built to other scales and is, in any case, not an important figure since, by means of levers, it can be magnified or reduced. The end of the drive shaft 18 remote from the electric motor projects through the gearbox 20 and has a head 23 on its projecting end. Axial floating movement of the shaft 18 is resisted by two similar compression springs 24,25 disposed on the shaft on opposite sides of the gearbox. The spring 24 is located between the head 23 and one side of the gearbox casing whilst the other spring 25 is located between a collar 26 fastened to the drive shaft and the opposite side of the gearbox casing. Appropriate thrust bearings 27 should be provided to minimise friction between the stationary and rotating components. Under the substantially equal rating of these springs, the drive shaft assumes a mid or rest position with respect to the gearbox when no work is being performed by the locomotive, that is when the electric motor has no output. The drive shaft 18 is linked to the bell crank 11 by a rod 28 so that axial movement of the shaft rocks the bell crank. The rod 28 is connected to the shaft 18 by the head 23 in such a manner that it does not rotate with the shaft, and it is pivotally connected to the bell crank by a pivot pin 29 associated with a lug 30 secured to the bell crank.

When the electric motor operates to drive the model locomotive either forwards or backwards, the applied torque has the effect of displacing the drive shaft 18 backwards or forwards against the action of one of the springs 24,25. It is displaced by an amount proportional to the torque applied to the driving wheels of the model, the exact displacement being determined by the rate of the springs resisting its axial movement. The displacement thereby produced is transmitted by the rod 28 to the bell crank 11 so as to rock the latter and thereby raise or lower the radius rod 8. It will be apparent that with this arrangement, the configuration of the Walscheart's gear can be caused to vary in a similar manner to the valve gear fitted to the real locomotive.

Whilst a particular embodiment has been described, it will be understood that various modifications can be made without departing from the scope of this invention as defined by the appended claims. For example, it is not essential that the electric drive motor be installed in the model with its shaft in a fore and aft direction. This is merely the arrangement that is normally adopted in practice. Moreover, whilst the invention has been particularly described in terms of operating a Walscheart's valve gear, it will be appreciated that the invention can be applied to models fitted with other types of valve gear, which in a real locomotive alter their configuration under the control of the driver. In normal circumstances, such an alteration in configuration is achieved in a similar manner to that described above, that is, by operation of rodding and bell cranks connected to a movable component or components. Accordingly, the invention may readily be applied to other types of valve gear, such as Baker, Stephenson's, Southern, Young's, Joy, Heisinger, Gouch or Allan valve gear. The application of the invention to these valve gears is not described in detail but it will be apparent to persons skilled in the art that any of these valve gears can be similarly made to operate in a realistic manner by coupling a torque responsive device, which is responsive to the torque applied by the electric drive motor of the model, to a movable component or components of these valve gears.

I claim:

1. In a model of a steam locomotive including an electric drive motor connected to drive said locomotive and a model reproduction of a valve gear which, in the real locomotive, regulates a steam control valve of a steam cylinder for controlling the pulling power of the locomotive, the improvement comprising means for continuously changing the configuration of said model valve gear in accordance with the required pulling power and direction of movement of said model for positioning said model valve gear to substantially correspond to that of the real locomotive when operating under similar conditions, said means comprising torque responsive means responsive to the torque and the direction of torque of said electric motor for producing a movement indicative of said torque and its direction, and means connecting said torque responsive means to said model valve gear for changing the configuration and position of the model valve gear, to substantially correspond to that of the real locomotive, in response to said movement.

2. The improvement claimed in claim 1, wherein said torque responsive means includes means movable linearly response to the torque of said motor for producing a linear output in opposite directions depending on the amount and the direction of said applied torque, and said connecting means connects said linearly movable member to said model valve gear.

3. The improvement claimed in claim 2, wherein said linearly movable means comprises a drive shaft coupling said electric motor to at least one drive wheel of said model, means mounting said drive shaft for limited floating movement thereof in a generally axial direction, and spring means for controlling axial movement of said drive shaft, said drive shaft being axially movable in response to said applied torque against the action of said spring means.

4. The improvement claimed in claim 3, including gearbox means coupling said drive shaft to an axle of said at least one driving wheel, said gearbox means comprising first gear means fastened to said drive shaft and meshing with second gear means connected to said axle, said first and second gear means interacting upon turning of said first gear means for moving said drive shaft axially in response to the torque applied to said first gear means by said drive shaft.

5. The improvement claimed in claim 4, wherein said drive shaft projects through said gearbox means and is slidably mounted therein, first stop means is disposed on said projecting end of said drive shaft, second stop means is disposed on said drive shaft on the opposite side of said gearbox to said first stop means, spring means is disposed between said first and second stop means and said gearbox and urges said drive shaft towards a rest position relative to said gearbox, said connecting means comprises an axially movable rod member, means connecting one end of said rod member to said projecting end of said drive shaft so as to transmit linear movement thereof to said rod member without rotating said rod member, and means connecting the opposite end of said rod member to a rockable member of said model valve gear whereby to alter the configuration thereof.

6. The improvement claimed in claim 5, wherein said drive shaft extends fore and aft of said model, said gearbox couples said drive shaft to an axle of a set of driving wheels for said model representing the drive wheels of the real locomotive, said spring means comprises coil springs disposed respectively between said first and second stop means and said gearbox to control axial movement of said drive shaft, and said rod member is disposed fore and aft of said model.

* * * * *